US011765496B1

(12) United States Patent
Tsai et al.

(10) Patent No.: US 11,765,496 B1
(45) Date of Patent: Sep. 19, 2023

(54) IN-EAR EARPHONE

(71) Applicant: Merry Electronics(Shenzhen) Co., Ltd., ShenZhen (CN)

(72) Inventors: Chan-Tsung Tsai, Taichung (TW); Tien-Fu Huang, Taichung (TW); Ke Chin Wang, Taichung (TW)

(73) Assignee: Merry Electronics(Shenzhen) Co., Ltd., ShenZhen (CN)

( * ) Notice: Subject to any disclaimer, the term of this patent is extended or adjusted under 35 U.S.C. 154(b) by 0 days.

(21) Appl. No.: 17/824,918

(22) Filed: May 26, 2022

(51) Int. Cl.
*H04R 1/10* (2006.01)
*H04R 1/08* (2006.01)

(52) U.S. Cl.
CPC ..... *H04R 1/1083* (2013.01); *H04R 1/08* (2013.01); *H04R 1/1016* (2013.01); *H04R 1/1075* (2013.01)

(58) Field of Classification Search
CPC . H04R 1/00; H04R 1/02; H04R 1/023; H04R 1/028; H04R 1/08; H04R 1/083; H04R 1/10; H04R 1/1016; H04R 1/1083; H04R 1/1075; H04R 1/28; H04R 1/2807; H04R 1/2811; H04R 1/2823; H04R 1/2826; H04R 1/2846; H04R 1/2849; H04R 25/60; H04R 25/65; H04R 2201/02; H04R 2201/10; H04R 2201/34; H04R 2225/025; H04R 2460/01
See application file for complete search history.

(56) References Cited

U.S. PATENT DOCUMENTS

| | | | | |
|---|---|---|---|---|
| 11,206,471 | B1 * | 12/2021 | Seo | H04R 1/1016 |
| 2014/0348372 | A1 * | 11/2014 | Seo | H04R 1/1016 381/380 |
| 2016/0316292 | A1 * | 10/2016 | Huang | H04R 1/1091 |
| 2021/0021920 | A1 * | 1/2021 | Choi | H04R 1/1016 |
| 2021/0144462 | A1 * | 5/2021 | Kim | H04R 1/2823 |

FOREIGN PATENT DOCUMENTS

| | | | | |
|---|---|---|---|---|
| CN | 216414550 U | * | 4/2022 | H04R 1/10 |
| TW | 201244505 A | * | 11/2012 | H04R 5/033 |

* cited by examiner

*Primary Examiner* — Thang V Tran
(74) *Attorney, Agent, or Firm* — JCIPRNET

(57) ABSTRACT

An in-ear earphone, including a casing, a speaker, and an attenuation guide, is provided. The casing includes a sound outlet and a first through hole. An inside of the casing has a first accommodating space. The speaker is disposed in the first accommodating space. The casing defines a front cavity and a rear cavity by the speaker. The attenuation guide is formed in the casing and includes at least a first attenuation channel and a second attenuation channel. The first attenuation channel has a first inlet and a first outlet. The first inlet is connected to the first through hole. The second attenuation channel has a second inlet and a second outlet. The second inlet, the first outlet, and the rear cavity are acoustically connected, and the second outlet is connected to the front cavity.

10 Claims, 5 Drawing Sheets

IN-EAR EARPHONE

BACKGROUND

Technical Field

The disclosure relates to an earphone, and in particular to an in-ear earphone.

Description of Related Art

When a user wears the in-ear earphone, a cavity isolated from the outside is formed between the eardrum of the user and the in-ear earphone, and the cavity tends to have a relatively high internal pressure. In order to reduce the internal pressure in the cavity, the in-ear headphone on the market generally have openings on the outer casing, and the openings are connected to the cavity between the eardrum of the user and the in-ear headphone, thereby releasing the internal pressure in the cavity.

However, in the current in-ear headphone, the path between the openings and the cavity is too short, so an external sound is easily transmitted to the eardrum of the user through the openings, thereby affecting the usage experience when the user is wearing the in-ear headphone. Therefore, how to improve the path between the openings and the cavity to reduce the interference of the external sound to the user is one of the research directions in the art.

SUMMARY

The disclosure provides an in-ear earphone, which can reduce the interference of an external sound to a user when wearing the earphone.

The in-ear earphone of the disclosure includes a casing, a speaker, and an attenuation guide. The casing includes a sound outlet and a first through hole, and an inside of the casing has a first accommodating space. The first through hole is connected to an external environment. The speaker is disposed in the first accommodating space of the casing. The casing defines a front cavity and a rear cavity by the speaker, and the front cavity and the sound outlet are acoustically connected. The attenuation guide is formed in the casing and includes at least a first attenuation channel and a second attenuation channel. The first attenuation channel has a first inlet and a first outlet, the first inlet is connected to the first through hole of the casing, and the first outlet is connected to the rear cavity of the casing. The second attenuation channel has a second inlet and a second outlet, the second inlet, the first outlet, and the rear cavity of the casing are acoustically connected, and the second outlet is connected to the front cavity of the casing. An external sound enters through the first through hole of the casing and enters the rear cavity through the first attenuation channel of the attenuation guide, is then guided to the front cavity through the second attenuation channel of the attenuation guide, and is guided out through the sound outlet.

In an embodiment of the disclosure, the in-ear headphone further includes a speaker holder, disposed in the first accommodating space of the casing. The speaker holder has a second accommodating space, the speaker is located in the second accommodating space, and the first inlet is formed on the speaker holder.

In an embodiment of the disclosure, the second attenuation channel is composed of at least two channels with different axial directions interlaced with each other.

In an embodiment of the disclosure, the speaker holder includes a main body and a convex portion protruding from the main body, the main body carries the speaker, and the first attenuation channel penetrates the convex portion along a first axis.

In an embodiment of the disclosure, the speaker holder includes a back surface facing the rear cavity and a groove recessed in the back surface, and the groove extends along a second axis to be connected to the second attenuation channel.

In an embodiment of the disclosure, the in-ear headphone further includes a sound emitting pipe, protruding from the speaker holder. The front cavity includes at least part of the sound emitting pipe.

In an embodiment of the disclosure, the sound emitting pipe and the speaker holder are integrated, and the sound emitting pipe passes through the sound outlet of the casing.

In an embodiment of the disclosure, the in-ear headphone further includes a structural member, adjacent to the speaker holder. The second attenuation channel is formed between the speaker holder and the structural member.

In an embodiment of the disclosure, the in-ear headphone further includes a microphone and a sound receiving channel, one end of the sound receiving channel is connected to a sound receiving port of the microphone, and other end is connected to the second attenuation channel. The second attenuation channel and the sound receiving channel form a sound receiving path of the microphone.

In an embodiment of the disclosure, the in-ear headphone further includes a structural member, adjacent to the speaker holder and including a first surface and a second surface opposite to each other. The sound receiving channel penetrates the first surface and the second surface, the first surface faces the speaker holder, the microphone is disposed on the second surface, and the microphone and the second attenuation channel are acoustically connected through the sound receiving channel.

Based on the above, in the in-ear headphone of the disclosure, the external sound enters the first attenuation channel through the first through hole of the casing, then sequentially passes through the rear cavity, the second attenuation channel, and the front cavity, and is finally guided out through the sound outlet and is transmitted to the eardrum of the user. Thereby, the energy of the external sound can be effectively attenuated due to the winding path during transmission to reduce the interference of the external sound to the user when wearing the earphone, and improve the usage experience when the user is wearing the earphone.

DETAILED DESCRIPTION OF DISCLOSED EMBODIMENTS

Figure 1:
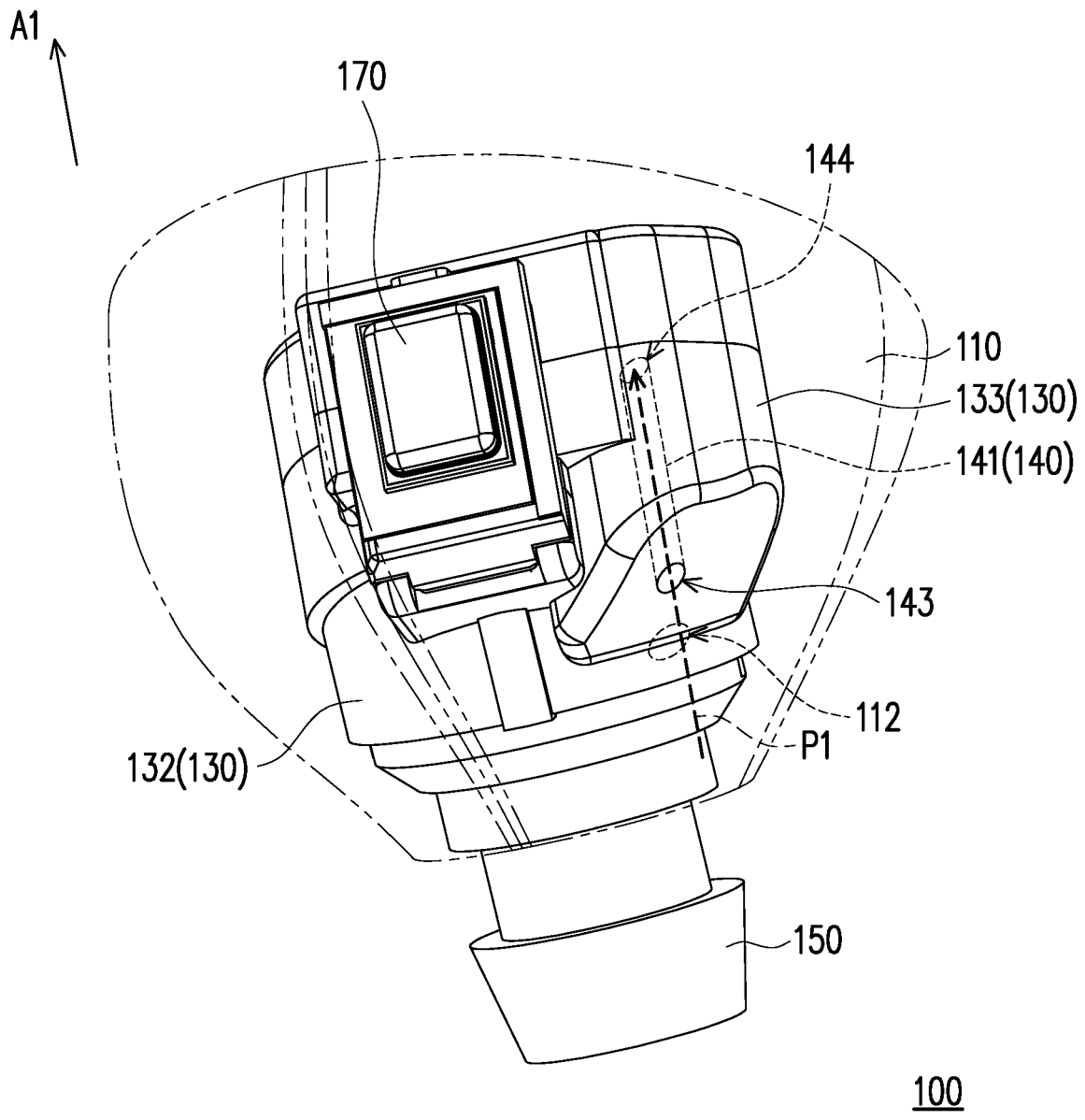
FIG. 1 is a three-dimensional view of an in-ear earphone according to an embodiment of the disclosure.
Figure 2:
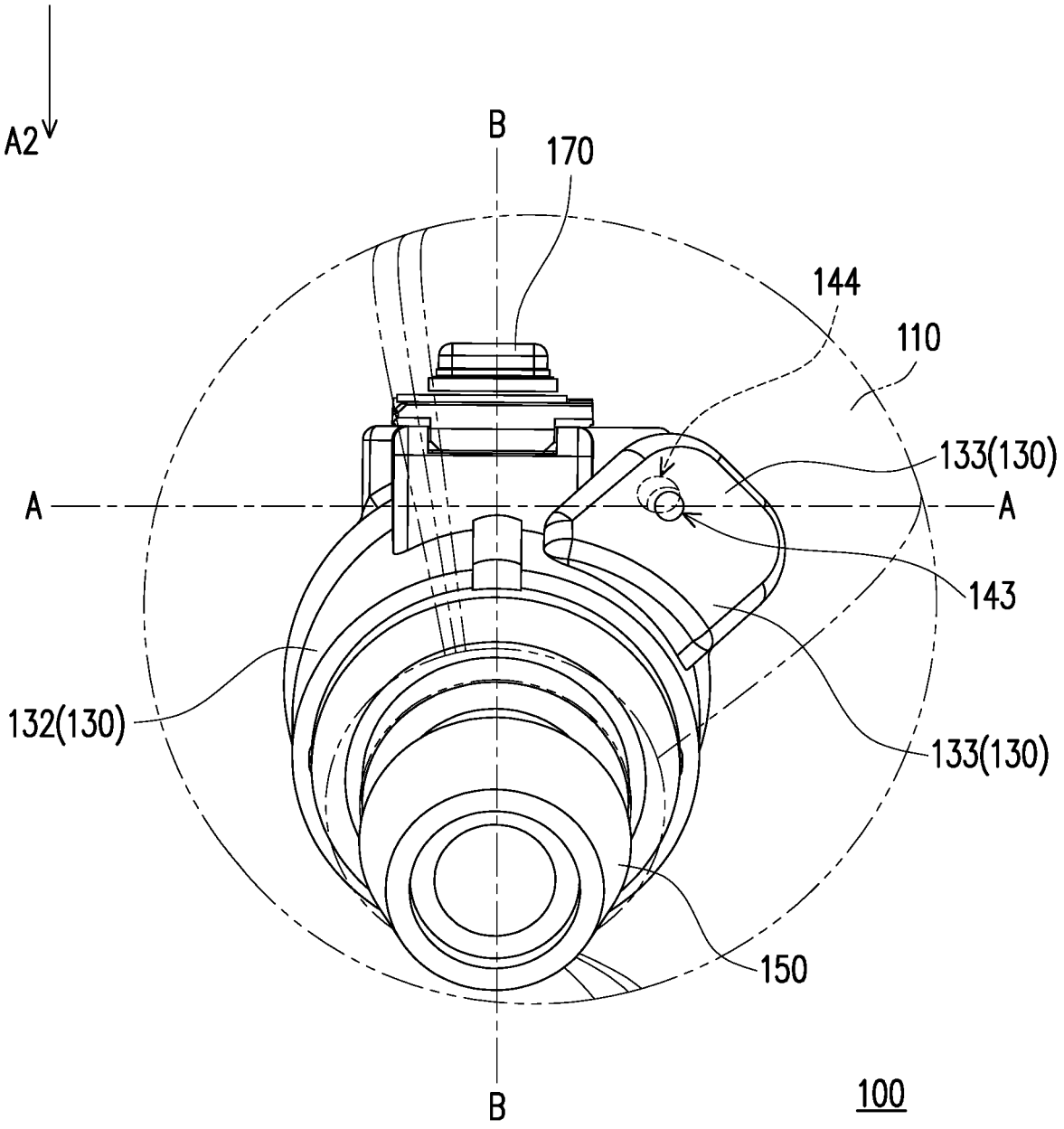
FIG. 2 is a three-dimensional view of the in-ear earphone of FIG. 1 from another viewing angle.
Figure 3:
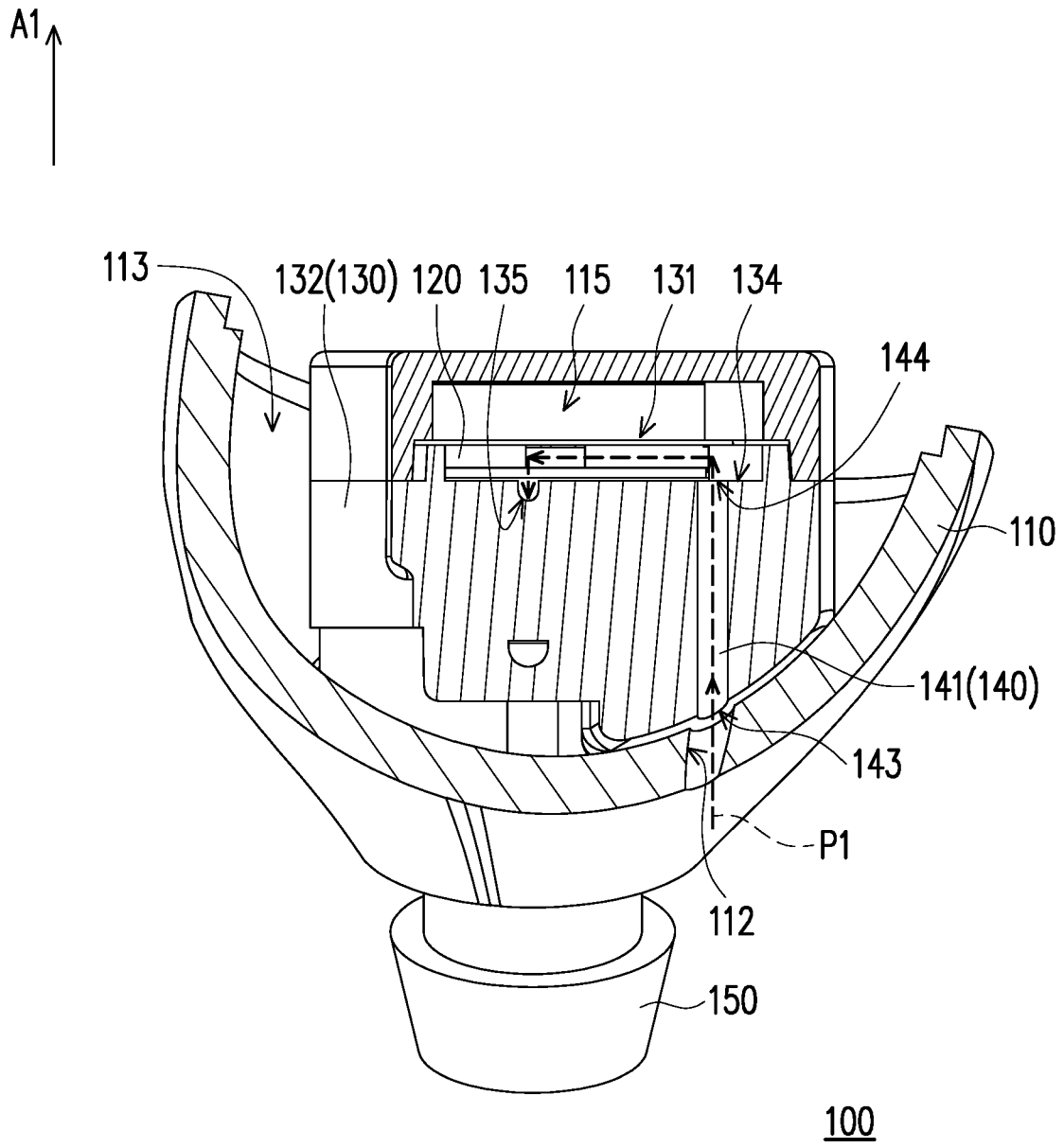
FIG. 3 is a side view of the in-ear earphone of FIG. 1 taken along a line segment A-A.

FIG. 1 is a three-dimensional view of an in-ear earphone according to an embodiment of the disclosure, FIG. 2 is a three-dimensional view of the in-ear earphone of FIG. 1 from another viewing angle, and FIG. 3 is a side view of the in-ear earphone of FIG. 1 taken along a line segment A-A.

It should be noted that in FIG. 1 and FIG. 2, the illustration of some components is omitted, and some components of FIG. 1 and FIG. 2 are illustrated in a perspective manner for the purposes of clear representation and convenient description.

Please refer to FIG. 1 to FIG. 3. An in-ear earphone 100 of the embodiment includes a casing 110, a speaker 120 (FIG. 3), a speaker holder 130, and an attenuation guide 140. The casing 110 includes a first through hole 112, and the first through hole 112 is connected to the external environment as shown in FIG. 1. In addition, the casing 110 includes a first accommodating space 113 (FIG. 3), and the speaker 120 and the speaker holder 130 are disposed in the first accommodating space 113 of the casing 110 as shown in FIG. 3.

Further, the speaker holder 130 of the embodiment has a second accommodating space 131 (FIG. 3), and the speaker holder 130 includes a main body 132 and a convex portion 133 protruding from the main body 132. The speaker 120 is adapted to be carried in the second accommodating space 131 by the main body 132 as shown in FIG. 3.

In the embodiment, the attenuation guide 140 is formed inside the casing 110, and a first damping channel 141 of the attenuation guide 140 penetrates the convex portion 133 along the direction of a first axis A1 as shown in FIG. 1. In addition, the first attenuation channel 141 has a first inlet 143 and a first outlet 144, and the first inlet 143 is formed on the convex portion 133 of the speaker holder 130. The first inlet 143 is connected to the first through hole 112 in the direction of the first axis A1 as shown in FIG. 1, but in other embodiments of the disclosure, the first inlet 143 and the first through hole 112 may be connected through a manner of not being on the same axis, which is not limited in the disclosure.

Figure 4:
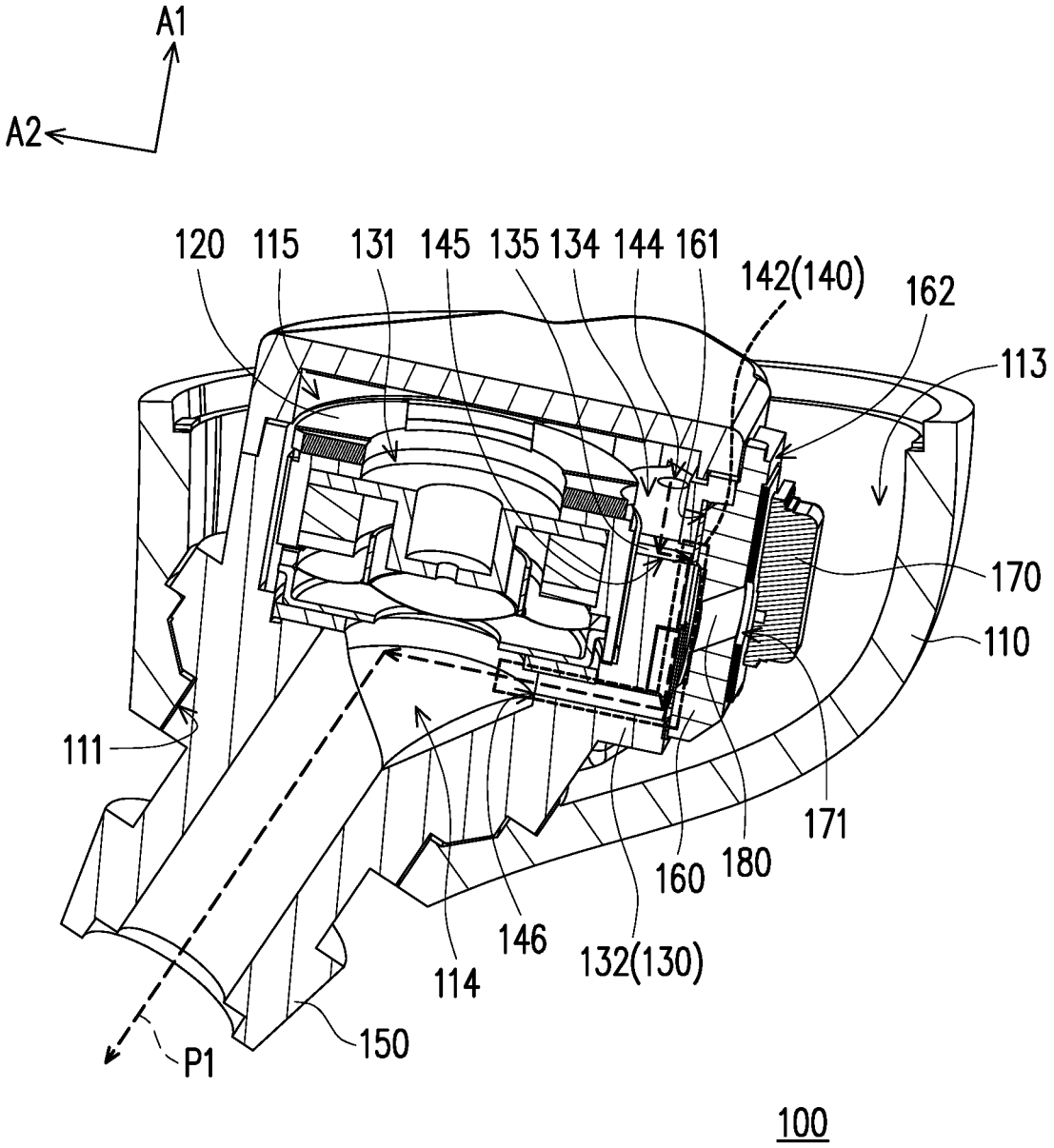
FIG. 4 is a three-dimensional view of the in-ear earphone of FIG. 1 taken along a line segment B-B.

FIG. 4 is a three-dimensional view of the in-ear earphone of FIG. 1 taken along a line segment B-B. Please refer to FIG. 3 and FIG. 4. The casing 110 of the embodiment includes a sound outlet 111 (FIG. 4), and a front cavity 114 and a rear cavity 115 are defined by the speaker 120 inside the casing 110 as shown in FIG. 4. The front cavity 114 and the sound outlet 111 are acoustically connected.

In the embodiment, the attenuation guide 140 includes at least the first attenuation channel 141 and a second attenuation channel 142. The first outlet 144 of the first attenuation channel 141 is connected to the rear cavity 115 of the casing 110, and the second attenuation channel 142 has a second inlet 145 and a second outlet 146. The second inlet 145, the first outlet 144, and the rear cavity 115 of the casing 110 are acoustically connected, and the second outlet 146 is connected to the front cavity 114 of the casing 110. The second attenuation channel 142 is composed of at least two channels with different axial directions interlaced with each other.

Specifically, as shown in FIG. 4, the two channels with different axial directions respectively extend along the direction of the first axis Al and the direction of a second axis A2, and the extending directions of the two channels are perpendicular to each other. However, in other embodiments of the disclosure, the respective extending directions of the two channels may not be vertical, and the number of channels may not be two, which is not limited in the disclosure.

In the embodiment, the speaker holder 130 includes a back surface 134 facing the rear cavity 115 and a groove 135 recessed in the back surface 134. The groove 135 extends along the direction of the second axis A2 (FIG. 4) to be connected to the second inlet 146 of the second attenuation channel 142. Thereby, the first outlet 144 of the first attenuation channel 141 and the rear cavity 115 of the casing 110 are connected to the second inlet 146 of the second attenuation channel 142 through the groove 135, so that the first attenuation channel 141 and the second attenuation channel 142 may be acoustically connected.

Under such configuration, the in-ear headphone 100 of the embodiment may enable the external sound to travel through a sound transmission path P1. The external sound first enters through the first through hole 112 of the casing 100 and enters the rear cavity 115 through the first attenuation channel 141 of the attenuation guide 140, then passes through the groove 135, is guided to the front cavity 114 through the second attenuation channel 142 of the attenuation guide 140, and is guided out through the sound outlet 111. In this way, the energy of the external sound can be effectively attenuated due to the winding path during transmission to reduce the interference of the external sound to the user when wearing the earphone, and improve the usage experience when the user is wearing the earphone.

In the embodiment, the in-ear earphone 100 further includes a sound emitting pipe 150. The sound emitting pipe 150 protrudes from the speaker holder 130, and the front cavity 114 includes at least part of the sound emitting pipe 150. As shown in FIG. 4, the sound emitting pipe 150 passes through the sound outlet 111 of the casing 110. In detail, the sound emitting pipe 150 and the speaker holder 130 of the embodiment are integrally formed as shown in FIG. 4. However, in other embodiments of the disclosure, the sound emitting pipe 150 and the casing 110 may be integrally formed, or the design of the sound emitting pipe 150 may be omitted from the in-ear earphone 100, so that the sound emitted by the speaker 120 is directly guided out through the sound outlet 111 of the casing 110, which is not limited in the disclosure.

In the embodiment, the in-ear earphone 100 further includes a structural member 160, a microphone 170, and a sound receiving channel 180. The structural member 160 is adapted to carry the microphone 170, and the structural member 160 is adjacent to the speaker holder 130. A part of the second attenuation channel 142 is formed between the speaker holder 130 and the structural member 160 as shown in FIG. 4. In addition, the structural member 160 includes a first surface 161 and a second surface 162 opposite to each other. The first surface 161 faces the speaker holder 130, and the second surface 162 is provided with the microphone 170. The sound receiving channel 180 penetrates the first surface 161 and the second surface 162, and the microphone 170 and the second attenuation channel 142 are acoustically connected through the sound receiving channel 180.

Figure 5:
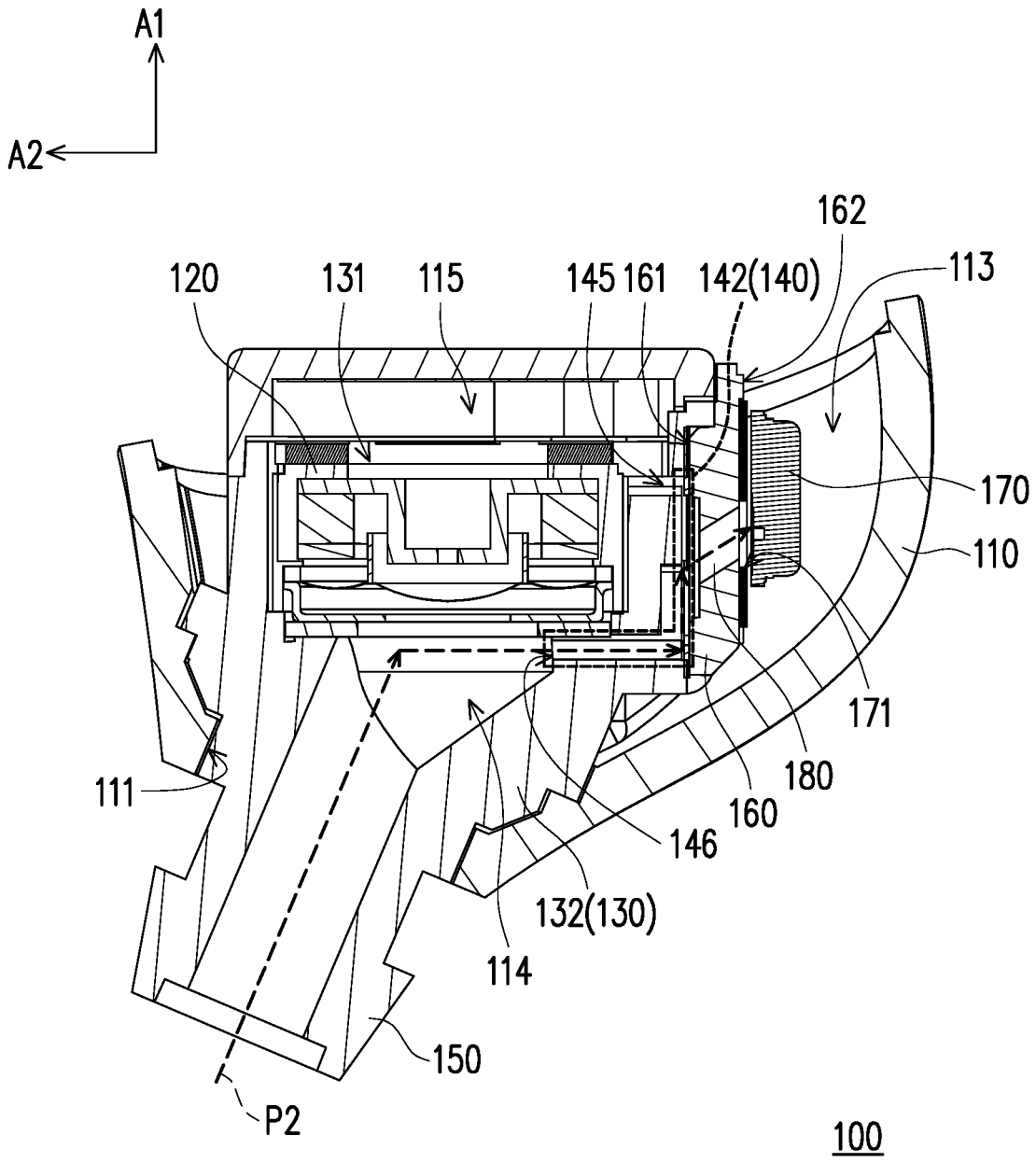
FIG. 5 is a side view of the in-ear earphone of FIG. 4.

FIG. 5 is a side view of the in-ear earphone of FIG. 4. Please refer to FIG. 5. In detail, one end of the sound receiving channel 180 of the embodiment is connected to a sound receiving port 171 of the microphone 170, and the other end of the sound receiving channel 180 is connected to the second attenuation channel 142. Thereby, the sound outlet 111, the front cavity 114, at least part of the second attenuation channel 142, and the sound receiving channel 180 may form a sound receiving path P2 of the microphone 170. The voice of the user may first enter through the sound outlet 111, sequentially pass through the front cavity 114, the second attenuation channel 142, the sound receiving channel 180, and the sound receiving port 171, and be finally received through the microphone 170. It is worth mentioning that the sound transmission path P1 and the sound receiving path P2 of the in-ear headphone 100 partially overlap to avoid the need for an additional path design of the in-ear headphone 100, which can save the internal space of the in-ear headphone 100.

In summary, the in-ear headphone of the disclosure includes the first attenuation channel and the second attenuation channel. The external sound first enters through the first through hole of the casing and enters the rear cavity through the first attenuation channel, is then guided to the front cavity through the second attenuation channel, and is guided out through the sound outlet.

In this way, the energy of the external sound can be effectively attenuated due to the winding path during transmission to reduce the interference of the external sound to the user when wearing the earphone, and improve the usage experience when the user is wearing the earphone.

What is claimed is:

1. An in-ear headphone, comprising:

a casing, comprising a sound outlet and a first through hole, wherein an inside of the casing has a first accommodating space, and the first through hole is connected to an external environment;

a speaker, disposed in the first accommodating space of the casing, wherein the casing defines a front cavity and a rear cavity by the speaker, and the front cavity and the sound outlet are acoustically connected; and an attenuation guide, formed in the casing and comprising at least a first attenuation channel and a second attenuation channel, wherein the first attenuation channel has a first inlet and a first outlet, the first inlet is connected to the first through hole of the casing, the first outlet is connected to the rear cavity of the casing, the second attenuation channel has a second inlet and a second outlet, the second inlet, the first outlet, and the rear cavity of the casing are acoustically connected, and the second outlet is connected to the front cavity of the casing;

wherein an external sound enters through the first through hole of the casing and enters the rear cavity through the first attenuation channel of the attenuation guide, is then guided to the front cavity through the second attenuation channel of the attenuation guide, and is guided out through the sound outlet.

2. The in-ear earphone according to claim 1, further comprising: a speaker holder, disposed in the first accommodating space of the casing, wherein the speaker holder has a second accommodating space, the speaker is located in the second accommodating space, and the first inlet is formed on the speaker holder.

3. The in-ear earphone according to claim 1, wherein the second attenuation channel is composed of at least two channels with different axial directions interlaced with each other.

4. The in-ear earphone according to claim 2, wherein the speaker holder comprises a main body and a convex portion protruding from the main body, the main body carries the speaker, and the first attenuation channel penetrates the convex portion along a first axis.

5. The in-ear earphone according to claim 2, wherein the speaker holder comprises a back surface facing the rear cavity and a groove recessed in the back surface, and the groove extends along a second axis to be connected to the second attenuation channel.

6. The in-ear earphone according to claim 2, further comprising: a sound emitting pipe, protruding from the speaker holder, wherein the front cavity comprises at least part of the sound emitting pipe.

7. The in-ear earphone according to claim 6, wherein the sound emitting pipe and the speaker holder are integrated, and the sound emitting pipe passes through the sound outlet of the casing.

8. The in-ear earphone according to claim 2, further comprising: a structural member, adjacent to the speaker holder, wherein the second attenuation channel is formed between the speaker holder and the structural member.

9. The in-ear headphone according to claim 1, further comprising: a microphone and a sound receiving channel, wherein one end of the sound receiving channel is connected to a sound receiving port of the microphone, other end is connected to the second attenuation channel, and the sound outlet, the front cavity, the at least part of the second attenuation channel, and the sound receiving channel form a sound receiving path of the microphone.

10. The in-ear headphone according to claim 9, further comprising: a structural member, adjacent to the speaker holder and comprising a first surface and a second surface opposite to each other, wherein the sound receiving channel penetrates the first surface and the second surface, the first surface faces the speaker holder, the microphone is disposed on the second surface, and the microphone and the second attenuation channel are acoustically connected through the sound receiving channel.

* * * * *